US005641102A

United States Patent [19]

Hellweg

[11] Patent Number: 5,641,102

[45] Date of Patent: Jun. 24, 1997

[54] ADJUSTABLE ANGLE HOLSTER

[75] Inventor: Albert Wilhelm Hellweg, Vermont, Australia

[73] Assignee: Hellweg International Pty Ltd., Victoria, Australia

[21] Appl. No.: 397,781

[22] Filed: Mar. 3, 1995

[51] Int. Cl.[6] ..... F41C 33/02

[52] U.S. Cl. ..... 224/198; 224/911; 403/53; 403/61; 403/121

[58] Field of Search ..... 224/198, 911, 224/912, 252, 253, 677, 666; 403/121, 61, 53

[56] References Cited

U.S. PATENT DOCUMENTS

| | | | |
|---|---|---|---|
| 921,900 | 5/1909 | Shuster . | |
| 1,214,161 | 1/1917 | Hettinger et al. . | |
| 1,968,340 | 7/1934 | Glidden | 403/61 |
| 2,410,640 | 11/1946 | Engle . | |
| 2,531,170 | 11/1950 | Tacket . | |
| 2,641,395 | 6/1953 | Engle | 224/911 |
| 2,765,968 | 10/1956 | Gaylord . | |
| 2,917,213 | 12/1959 | Bucheimer et al. . | |
| 2,990,987 | 7/1961 | Handler . | |
| 3,117,708 | 1/1964 | Goldman | 224/911 |
| 3,168,972 | 2/1965 | Parlante et al. | 224/198 |
| 3,261,519 | 7/1966 | Horne . | |
| 3,610,487 | 10/1971 | Campos . | |
| 3,915,361 | 10/1975 | Perkins | 224/198 X |
| 3,923,214 | 12/1975 | Kippen . | |
| 4,068,961 | 1/1978 | Ebner et al. | 403/61 X |
| 4,094,450 | 6/1978 | Parlante . | |
| 4,253,592 | 3/1981 | Anderson | 224/198 |
| 4,419,794 | 12/1983 | Horton, Jr. et al. . | |
| 4,504,001 | 3/1985 | Nichols | 224/198 |
| 4,718,586 | 1/1988 | Hagino . | |
| 4,874,118 | 10/1989 | Parlante . | |
| 5,167,355 | 12/1992 | Hill | 224/911 |
| 5,193,725 | 3/1993 | Radocy . | |
| 5,265,781 | 11/1993 | Nichols | 224/198 |
| 5,269,448 | 12/1993 | Shoemaker . | |

*Primary Examiner*—Renee S. Luebke
*Attorney, Agent, or Firm*—Thompson Hine & Flory LLP

[57] ABSTRACT

The invention is a swivel holster to enable the pouch of a holster to move in a rotational and/or swivel manner relative to the belt-engaging member. The holster has an adjustable assembly between the holster and the belt loop. The assembly includes a concave first member for mating engagement with a convex second member, there being at least one friction-increasing surface between the first and second members to prevent unwanted relative movement therebetween. A bolt is used to secure the portions together.

16 Claims, 6 Drawing Sheets

ADJUSTABLE ANGLE HOLSTER

FIELD OF THE INVENTION

This invention relates to the adjustment means and refers particularly, though not exclusively, to adjustment means for use with holsters, as herein defined.

DEFINITIONS

Throughout this specification the word "Holster" is to be taken as including not only holsters of all kinds, but also pouches, magazine pouches, speedloader holders and pouches, handcuff holders and pouches, truncheon holders and pouches, mobile radio and telephone holders, and the like.

Furthermore, throughout this specification the word "Belt" is to be taken as including straps, webs, or like device; to which a Holster may be attached.

BACKGROUND

For many years Holsters have been attached to a Belt. No adjustment of the Holster relative to the Belt in relation to height or angle was possible. For many users of Holsters, including police and speed shooters, this has made using the Holster uncomfortable and/or slow.

It is therefore the principal object of the present invention to provide an adjustment means to enable a Holster to be adjustable relative to a Belt.

BRIEF DESCRIPTION OF THE INVENTION

With the above and other objects in mind, the present invention is an adjustable holster which allows the pouch portion of a holster to rotate and/or swivel relative to the portion of the holster that engages the belt. The holster of the present invention includes a concave and a convex member which have a "friction-increasing" surface between them. These members are located intermediate the pouch and belt-engaging portions and have a fastener therethrough. When the fastener is not fully tightened, the members rotate and/or swivel relative to one another which provides the holster with adjustability.

Preferably, the friction-increasing surface is integral with the first member and the second member. The friction-increasing surface may comprise a surface treatment on either or both of the first member and the second member, and may be selected from radial ribs, concentric ribs, indentations and projections, or any combination of these. Alternatively, the friction-increasing surface may include a washer of a friction-increasing material located between the first member and the second member. The washer may be of any suitable material such as, for example, leather, rubber, neoprene, or polystyrene.

One of said first member and said second member is attached to a Holster in the pouch of a Holster, whereas the other is attached to a Belt, or to that part of the Holster which is attached to the Belt.

DESCRIPTION OF THE DRAWINGS

In order that the invention may be readily understood, there shall now be described preferred constructions of adjustment means incorporating the principal features of the present invention, the description being by way of non-limitative example only and being with reference to the accompanying illustrative drawings in which.

DESCRIPTION OF PREFERRED EMBODIMENT

Figure 1:
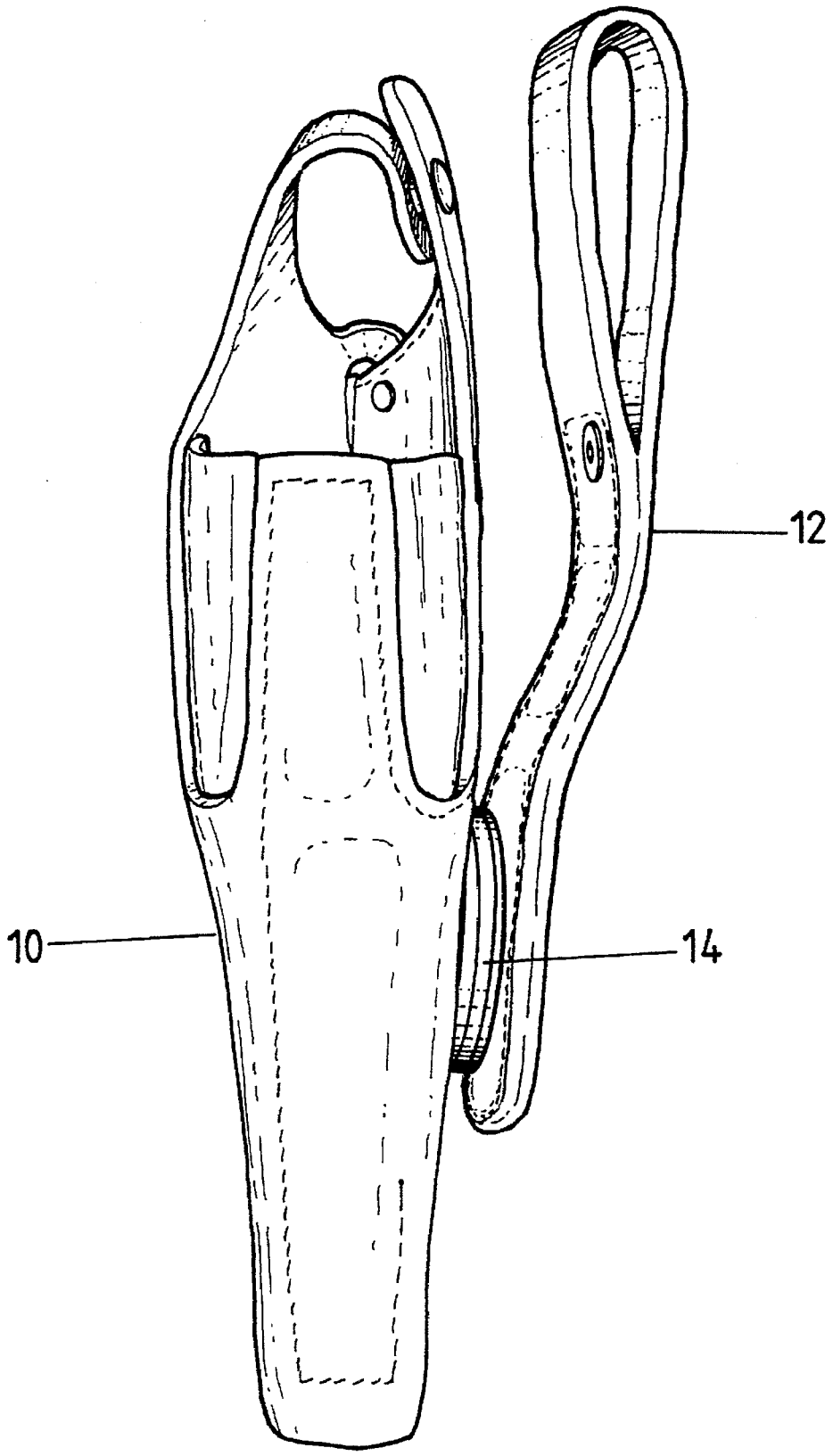
FIG. 1 is a front view of a Holster incorporating a first embodiment of the present invention.
Figure 2:
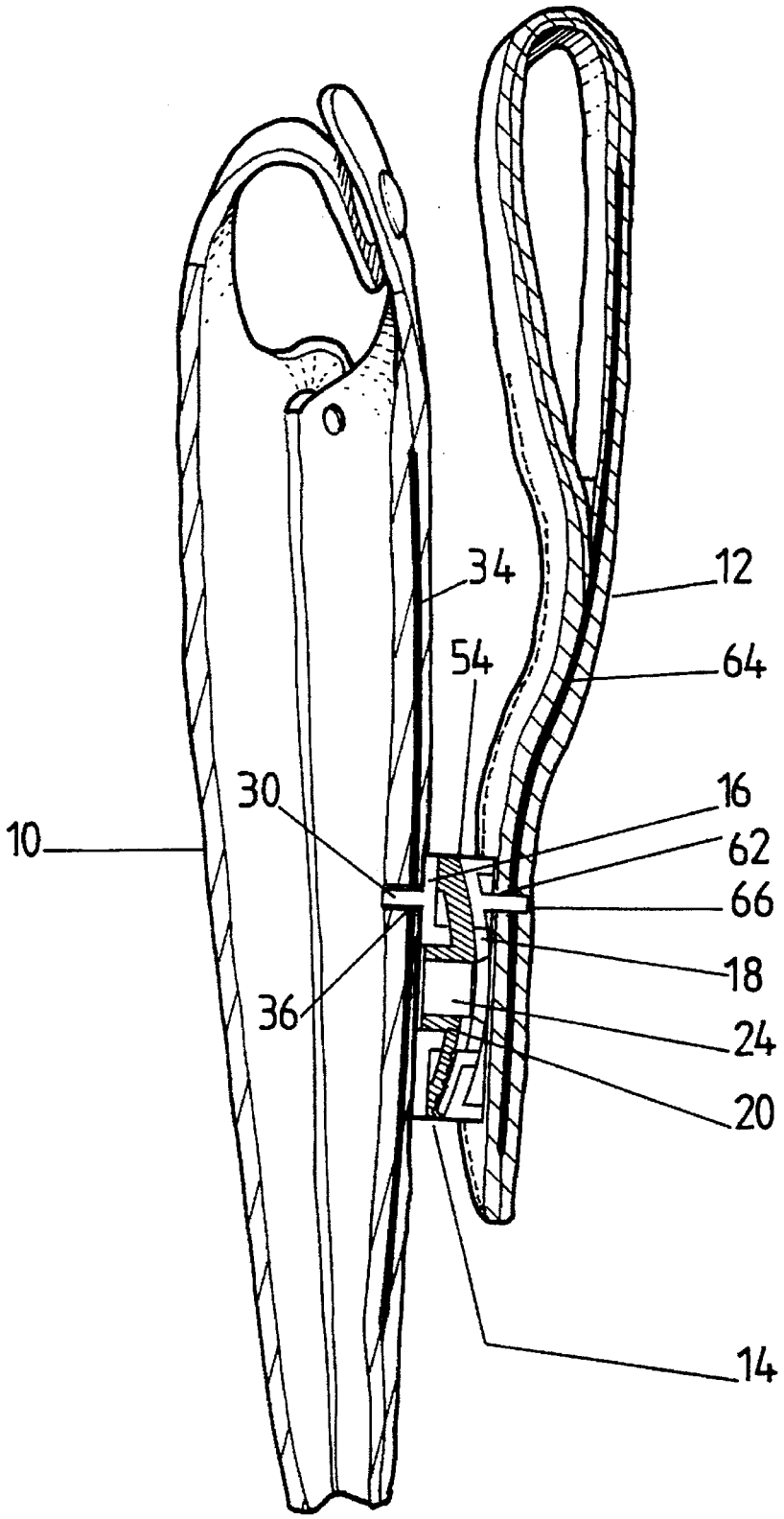
FIG. 2 is a vertical cross-sectional view of the Holster of FIG. 1.
Figure 3:
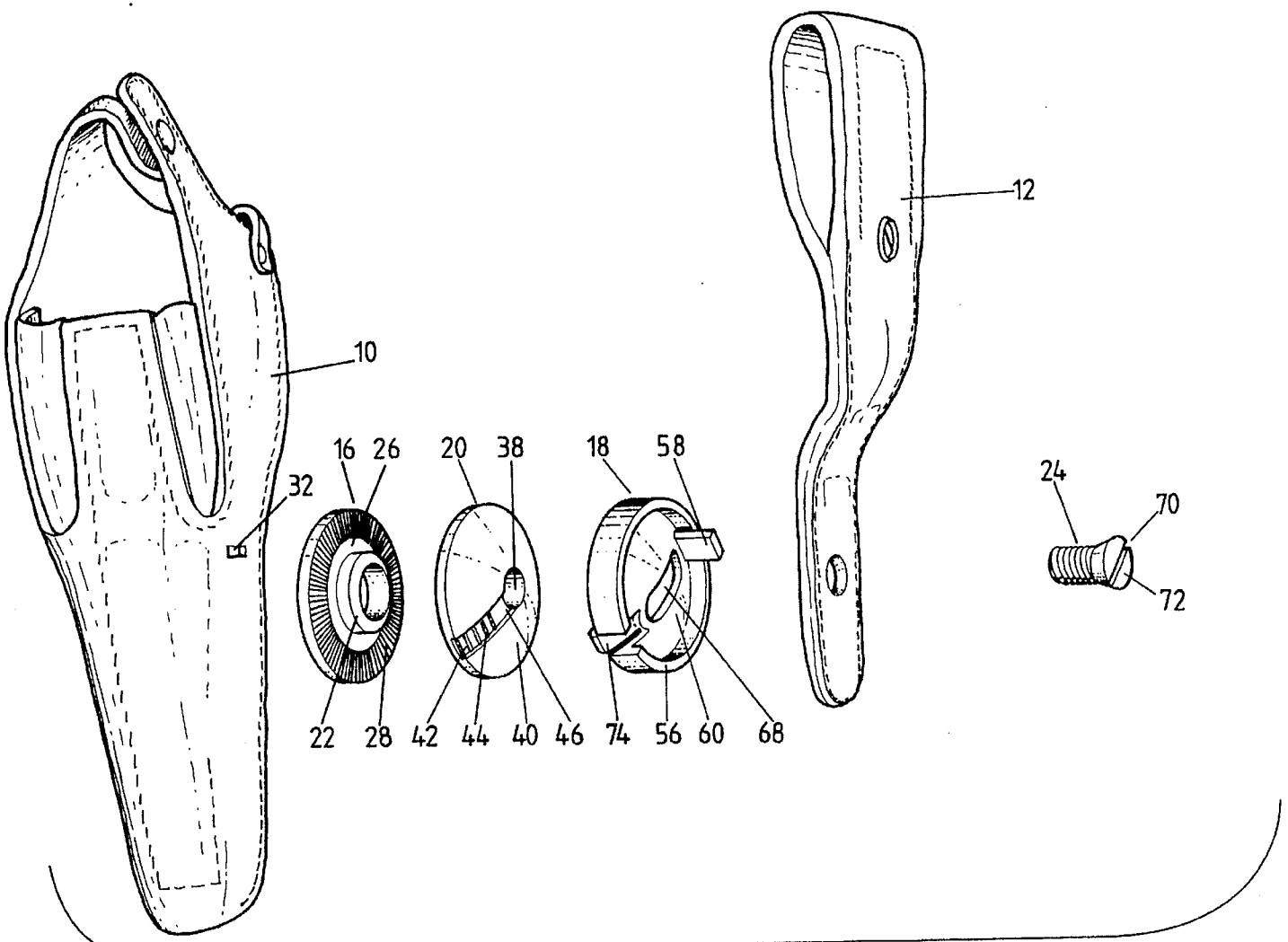
FIG. 3 is an exploded perspective view of the Holster of FIGS. 1 and 2.

As shown in FIGS. 1 to 3, there is a Holster for attachment to a Belt (not shown), and which includes a pouch 10 for receiving a weapon or the like, and a Belt engaging portion 12. The pouch 10 is operatively connected to the Belt engaging portion 12 by an adjustment means 14.

The adjustment means 14 includes a convex member 16, a concave member 18, and an intermediate member 20. The convex member 16 has a central boss 22 through which a securing bolt 24 is intended to pass. The convex member 16 has an upper surface 26 having radial ribs 28 thereon. Extending downwardly from the convex member 16 is a first pin 30 which engages in a hole 32 in pouch 10. If the pouch 10 has a reinforcing member 34, the pin 30 may pass through a hole 36 in that reinforcing member 34. The cooperation of the pin 30 and hole 32 ensures that rotation of the pouch 10 will cause rotation of the convex member 16.

The intermediate member 20 is dished and also has a boss 38 which engages within boss 22. Again, bolt 24 passes through boss 38. The axial length of boss 38 is the same as, or less than, the axial length of boss 22. The upper surface 40 has a radial groove 42 therein with transverse grooves 44 across the floor 46 of the groove 42. The upper surface 40 of the intermediate member 20 is convex, and its lower surface 48 is concave. At its periphery, the lower surface 48 has a rim 50 which is adapted to engage with ribs 28 on upper surface 26 of convex member 16. Preferably the rim 50 has at least one rib 52 similar to ribs 28 to enable there to be a gripping relationship between convex member 16 and intermediate member 20.

The concave member 18 has a lower surface 54 which is shaped to mate with the upper surface 40 of intermediate member 20. The concave member 18 has an upstanding peripheral skirt 56 and a pin 58 upstanding from upper surface 60. Pin 58 is engageable in a hole 62 in Belt engaging member 12 so that there will be no relative rotation of the concave member 18 relative to Belt engaging member 12. If Belt engaging member 12 has a reinforcing plate 64, it may be provided with a hole 66 into which pin 58 may pass.

The concave member 18 has an elongate slot 68 through which bolt 24 passes. Preferably, slot 68 is countersunk, and head 70 of bolt 24 is tapered so that the upper surface 72 of bolt head 70 is relatively flush with upper surface 60. Part of the concave member 18, generally designated as 74, is depressed from upper surface 60 and extends below lower surface 54. Part 74 is sized and shaped to be received in groove 42 in intermediate member 20, and has at least one rib 76 depending therefrom to engage with grooves 44. Part 74 cooperates with groove 42 so that unwanted rotation of intermediate member 20 relative to concave member 18 is prevented.

The arrangement of the parts is such that upon bolt 24 being loosened, pouch 10 can be moved by either convex member 16 rotating around bolt 24 relative to intermediate member 20, and thus concave member 18, to enable pouch 10 to rotate around bolt 24 relative to Belt engaging member 12; and/or by concave member 18 moving relative to intermediate member 20 to cause pouch 10 to swivel relative to Belt engaging member 12, with the cut-out part 74 sliding along groove 42. The limit of that swivel movement is defined by the length of slot 68. Once the pouch 10 is in the desired position relative to Belt engaging member 12, bolt 24 can be tightened to any suitable member as is known in the art. Suitable bolt connecting members include a threaded boss, loose nut, or captive nut.

Figure 4:
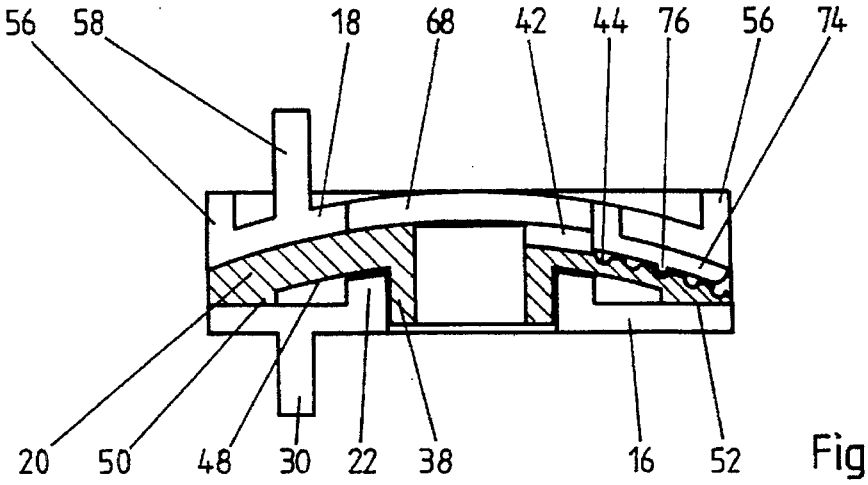
FIG. 4 is a vertical cross-sectional view of the adjustment means of the Holster of FIGS. 1 to 3 when in a central position.
Figure 5:
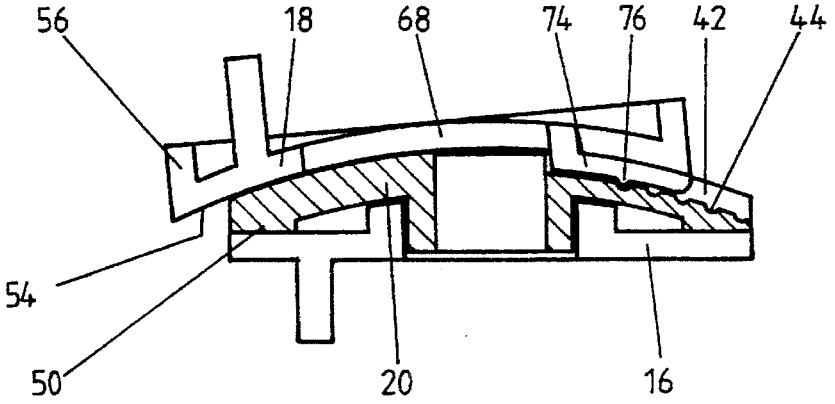
FIG. 5 is a view corresponding to that of FIG. 4 in a first adjusted position.
Figure 6:
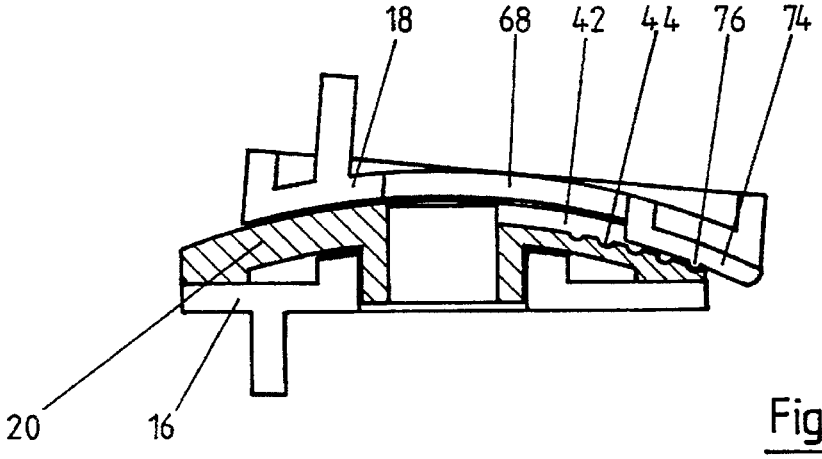
FIG. 6 is a view corresponding to that of FIGS. 4 and 5 in a second adjusted position.

FIGS. 4 to 6 show the swivel movement of concave member 18 relative to intermediate member 20. The engagement of rib 76 in grooves 44 can easily be seen.

Figure 7:
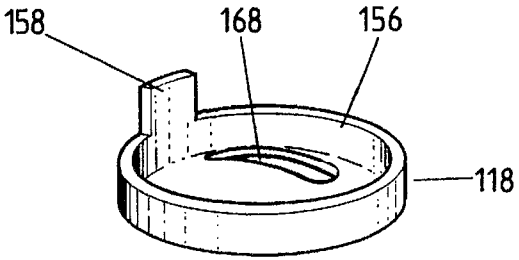
FIGS. 7(*a*)–7(*e*) is an exploded perspective view of four further embodiments of the adjustment means.
Figure 7:
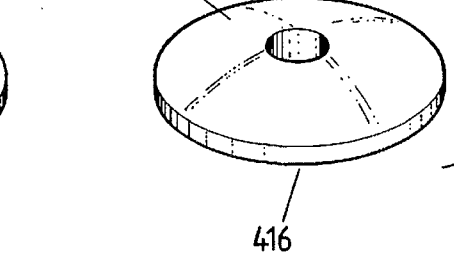
Figure 7:
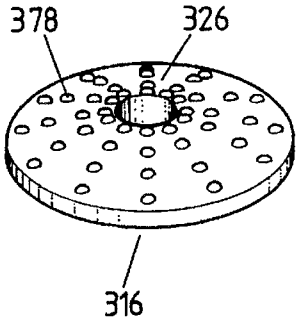
Figure 7:
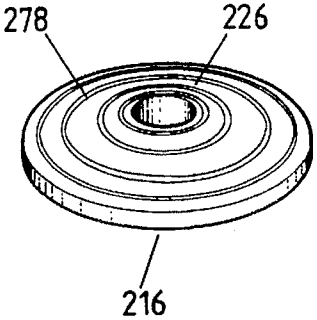
Figure 7:
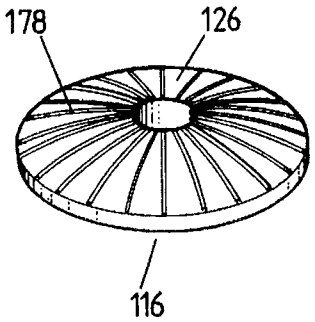

FIG. 7(*a*)–(*e*) shows four different embodiments. Like parts will be given like reference numerals, with the addition of a prefix number designating the embodiment concerned.

FIG. (7*a*) shows the concave member 118 has an upstanding skirt 156 and an upstanding pin 158, with the pin 158 being integral with the skirt 156. This relocation of the pin 158 to its maximum radial extent assists in providing the maximum swivel action. Slot 168 is as for the embodiment of FIGS. 1 to 6, but there is no cut-out part 74.

The lower surface (not shown) of concave member 118 is provided with a friction-increasing surface treatment the same as that on the convex member. There is no intermediate member with these embodiments.

The convex member may take one of a number of forms. The first shown in FIG. 7(*b*) is convex member 116 which has an upper surface 126 which is of a shape to mate with the lower surface of concave member 118. In this instance, upper surface 126 has radial ribs 178 extending the complete radius of upper surface 126. These cooperate with like ribs on the lower surface of concave member 118 to increase the surface-to-surface friction so that unwanted relative movement should not take place. By not having an intermediate member, the relative rotational and swivel movements take place directly between the convex member 116 and the concave member 118.

The second form shown in FIG. 7(*c*) is convex member 216 which has an upper surface 226 with concentric rings 278 adapted to cooperate with similar concentric rings on the lower surface of concave member 118.

The third form shown in FIG. 7(*d*) is convex member 316 which has an upper surface 326 with a plurality of radially and concentrically arranged indentations 378 adapted to cooperate with at least one pin (not shown) projecting downwardly from the lower surface of concave member 118.

The fourth form shown in FIG. 7(*e*) is convex member 416 which has a smooth upper surface 426. The lower surface of concave member 118 will also be smooth. A friction-increasing washer 478 is used to increase the surface-to-surface friction between upper surface 426 and the lower surface of concave member 118. Washer 478 may be made of any suitable material such as, for example, leather, rubber, PVC, neoprene, or an imitation of any or all of them.

Figure 8:
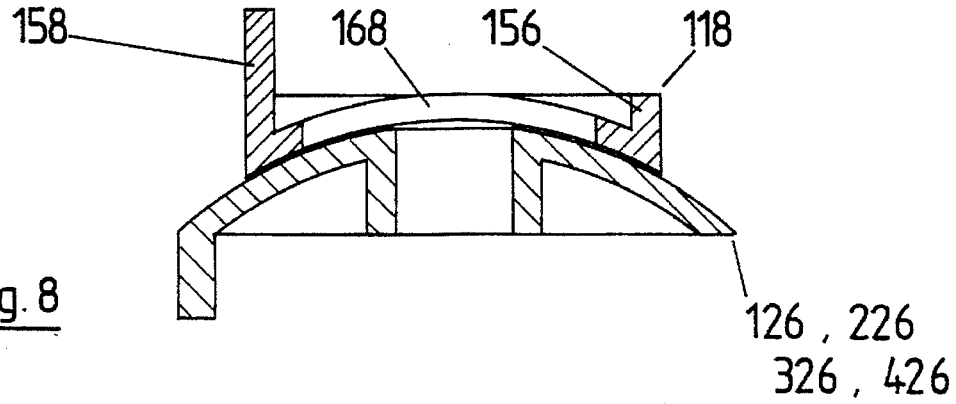
FIG. 8 is a vertical cross-sectional view of a sixth embodiment of the adjustment means in a central position.
Figure 9:
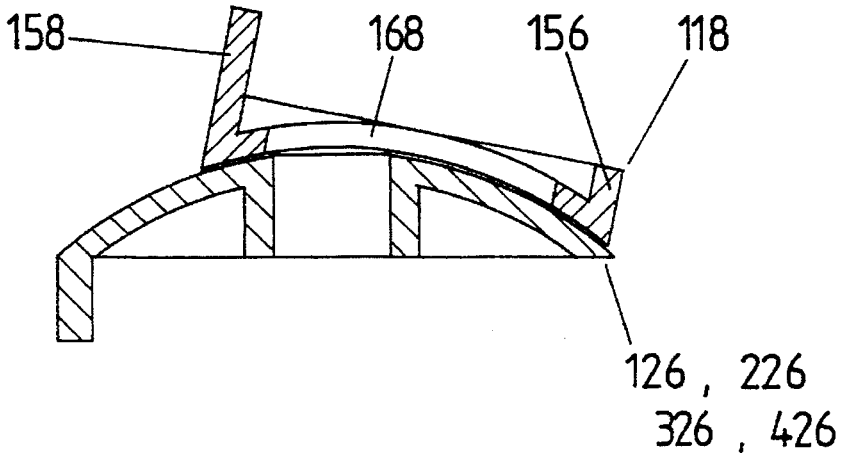
FIG. 9 is a view corresponding to that of FIG. 8 in a first adjusted position.
Figure 10:
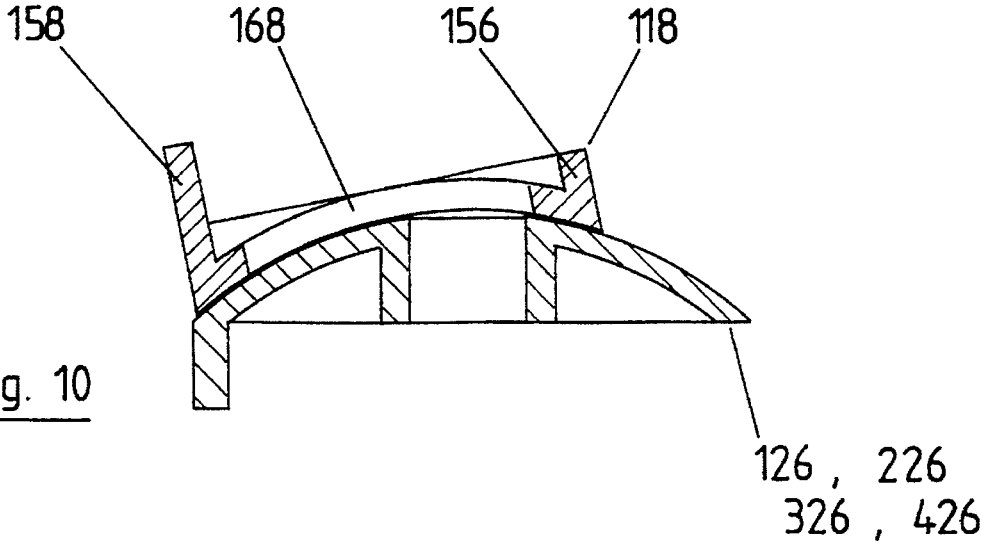
FIG. 10 is a view corresponding to that of FIGS. 8 and 9 in a second adjusted position.

FIGS. 8 to 10 show the rages of relative movement of the concave member 118 relative to the convex members 116, 216, 316 and 416. As can be seen, by comparison with the relative angles of FIGS. 4 to 6, a considerable increase in relative swivel movement is possible.

I claim:

1. An adjustable angle holster to enable a pouch of a holster to be adjustable relative to a belt engaging member comprising a concave first member having a centrally located elongate slot, and a convex second member, said first member being in mating engagement with said second member, there being provided at least one friction-increasing surface between said first member and second member to prevent unwanted relative movement therebetween, one of said first member and said second member being attached to said pouch and the other being attached to said belt engaging member; and a fastener adapted to secure said first member and second member together such that they move in a rotational and/or swivel manner relative to each other when the fastener is not fully tightened, wherein said first member has a pin extending upwardly from an upper surface thereof, to engage with either said pouch or said belt engaging member to which said first member is attached.

2. An adjustment means as claimed in claim 1, wherein said at least one friction increasing surface includes an upper surface of said second member having said friction-increasing surface and a lower surface of said first member having said friction-increasing surface, said upper surface and said lower surface forming said mating engagement.

3. An adjustment means as claimed in claim 2, wherein said friction-increasing surface comprises a plurality radially extending ribs.

4. An adjustment means as claimed in claim 2, wherein said friction-increasing surface comprises a plurality of concentric rings.

5. An adjustment means as claimed in claim 2, wherein said upper surface of said second member and said lower surface are relatively smooth, there being provided a washer therebetween to provide said friction-increasing surface.

6. An adjustment means as claimed in claim 1, wherein said at least one friction increasing surface includes an upper surface of said second member and a lower surface of said first member, said upper surface of said second member and said lower surface forming said mating engagement; and wherein one of said upper surface of said second member and said lower surface has a plurality of indentations and the other at least one pin adapted to engage in said plurality of indentations.

7. An adjustment means as claimed in claim 6, wherein said indentations are arranged in a radial and concentric manner.

8. An adjustment means as claimed in claim 7, wherein said indentations are in said upper surface of said second member and at least one pin extending downwardly from said lower surface.

9. An adjustment means to enable a holster to be able to be adjustable relative to a belt, said adjustment means including a first member for mating engagement with a second member, said first member being generally concave and said second member being generally convex, there being provided at least one friction-increasing surface between said first member and second member; said second member having a central opening adapted to receive a fastener therethrough, said first member having a centrally located elongate slot adapted to receive said fastener therethrough; said first member and said second member being adapted to move in a rotational and/or swivel manner relative to each other when said fastener is not fully tightened, wherein said first member has an upstanding skirt extending around a periphery thereof.

10. An adjustment means as claimed in claim 9, wherein said elongate slot is countersunk.

11. An adjustment means as claimed in claim 9, wherein said first member has a pin extending upwardly from an upper surface thereof, to engage with either said pouch or skid belt engaging member to which said first member is attached and wherein said pin is integral with said upstanding skirt.

12. An adjustment means as claimed in claim 9, wherein said first member has a pin extending upwardly from an upper surface thereof to engage with either said pouch or said belt engaging member which said first member is attached and wherein said pin is radially inwardly of said skirt.

13. An adjustment means to enable a holster to be able to be adjustable relative to a belt, said adjustment means including a first member for mating engagement with a second member, said first member being generally concave and said second member being generally convex, there being provided at least one friction-increasing surface between said first member and second member; said second member having a central opening adapted to receive a fastener therethrough, said first member having a centrally located elongate slot adapted to receive said fastener therethrough; said first member and said second member being adapted to move in a rotational and/or swivel-manner relative to each other when said fastener is not fully tightened, wherein said first member has a radially extending cut-out part extending downwardly therefrom to slidingly engage in a radially-extending groove in an upper surface of said second member; said cut-out part having a lower surface with at least one traverse rib, said groove having a plurality of transverse grooves extending thereacross.

14. An adjustment means as claimed in claim 13, wherein said cut-out part and said radial groove comprise said friction-increasing surface.

15. An adjustment means to enable a holster to be able to be adjustable relative to a belt, said adjustment means including a first member for mating engagement with a second member, said first member being generally concave and said second member being generally convex, there being provided at least one friction-increasing surface between said first member and second member; said second member having a central opening adapted to receive a fastener therethrough, said first member having a centrally located elongate slot adapted to receive said fastener therethrough; said first member and said second member being adapted to move in a rotational and/or swivel manner relative to each other when said fastener is not fully tightened, wherein said second member has a lower surface having a peripheral rim, said rim having a lower surface with at least one radial rib thereon.

16. An adjustment means as claimed in claim 15, wherein there is provided a third member beneath said second member, said third member having an upper surface with a plurality of radially extending ribs thereon adapted to cooperate with said at least one radial rib on said lower surface of said rim to restrain said third member and said second member from relative rotation when said fastener is tightened.

* * * * *